US010499720B2

(12) United States Patent
Caulier et al.

(10) Patent No.: US 10,499,720 B2
(45) Date of Patent: Dec. 10, 2019

(54) APPLICATOR FOR APPLYING A COSMETIC, MAKE-UP OR CARE PRODUCT

(71) Applicant: L'OREAL, Paris (FR)

(72) Inventors: Eric Caulier, Clichy (FR); Audrey Thenin, Clichy (FR); Antoine Lebrun, Clichy (FR); Pauline Prade, Clichy (FR)

(73) Assignee: L'OREAL, Paris (FR)

( * ) Notice: Subject to any disclaimer, the term of this patent is extended or adjusted under 35 U.S.C. 154(b) by 0 days.

(21) Appl. No.: 15/528,721

(22) PCT Filed: Nov. 20, 2015

(86) PCT No.: PCT/EP2015/077275
§ 371 (c)(1),
(2) Date: May 22, 2017

(87) PCT Pub. No.: WO2016/079325
PCT Pub. Date: May 26, 2016

(65) Prior Publication Data

US 2017/0273436 A1 Sep. 28, 2017

(30) Foreign Application Priority Data

Nov. 21, 2014 (FR) ..... 14 61290

(51) Int. Cl.
*A45D 34/04* (2006.01)
*A46B 5/02* (2006.01)
(Continued)

(52) U.S. Cl.
CPC ..... *A45D 34/045* (2013.01); *A45D 40/262* (2013.01); *A46B 5/02* (2013.01);
(Continued)

(58) Field of Classification Search
CPC .. A45D 34/041; A45D 34/042; A45D 34/043; A45D 34/045; A45D 34/048;
(Continued)

(56) References Cited

U.S. PATENT DOCUMENTS

D180,715 S * 7/1957 Henry et al. ..... 141/112
4,313,686 A * 2/1982 Proffer ..... B65D 51/32 401/127

(Continued)

FOREIGN PATENT DOCUMENTS

CN 102098944 A 6/2011
DE 20 2010 013 587 U1 1/2012

(Continued)

OTHER PUBLICATIONS

Dec. 25, 2017 Office Action issued in Chinese Patent Application No. 201580063149.7.

(Continued)

*Primary Examiner* — Tatiana L Nobrega
(74) *Attorney, Agent, or Firm* — Oliff PLC

(57) ABSTRACT

An applicator for applying an eye-liner, extending along a straight longitudinal axis, including: an application member, in particular an applicator tip, a support carrying the application member, extending along an exposed length along the longitudinal axis of the applicator, a handle defining a gripping surface allowing the user to hold the applicator when applying the product, the handle having at least one cross-section, considered perpendicularly to the longitudinal axis of the applicator, with a substantially triangular general shape, the handle extending along a length along the longitudinal axis of the applicator, the ratio of the length of the handle to the exposed length of the support being greater than 2, preferably between 2 and 7, and more preferably between 3 and 6, the handle having at least two cross-
(Continued)

Figure 1:
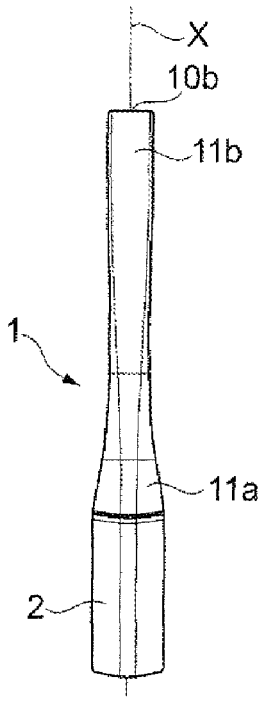

sections, separate from each other, with a substantially triangular general shape, the two cross-sections being angularly offset relative to each other.

9 Claims, 5 Drawing Sheets

(51) Int. Cl.
*A45D 40/26* (2006.01)
*A46B 9/02* (2006.01)
*B25G 1/10* (2006.01)

(52) U.S. Cl.
CPC ..... *A46B 5/021* (2013.01); *A46B 9/021* (2013.01); *B25G 1/102* (2013.01); *A45D 2200/1072* (2013.01)

(58) Field of Classification Search
CPC .. A45D 40/261; A45D 40/262; A45D 40/264; A45D 40/265; A45D 2200/1072; A46B 5/02; A46B 5/021; A46B 9/021; A46B 2200/1046; B25G 1/102
USPC ..... D28/7; 215/228; 220/212.5, 755; D9/723–725
See application file for complete search history.

(56) References Cited

U.S. PATENT DOCUMENTS 5,097,853 A * 3/1992 Nehashi ..... A45D 34/045 132/218
5,775,344 A * 7/1998 Clay ..... A45C 11/008 132/218
6,039,053 A * 3/2000 Turrentine ..... A45D 40/262 132/317
7,077,592 B2 7/2006 Gueret
D681,469 S * 5/2013 Mishan ..... D9/435
D732,975 S * 6/2015 Hua ..... D9/724
2002/0088473 A1* 7/2002 Fonseca ..... A46D 1/00 132/218
2004/0182410 A1* 9/2004 Gueret ..... A45D 40/265 132/218
2004/0195377 A1 10/2004 Williams et al.
2004/0202502 A1* 10/2004 Gueret ..... A45D 34/045 401/129
2005/0126584 A1* 6/2005 Hsu ..... A45D 40/26 132/218
2006/0188318 A1* 8/2006 Gueret ..... A45D 34/045 401/129
2008/0138138 A1* 6/2008 Gueret ..... A45D 34/04 401/24
2009/0154985 A1* 6/2009 Wyatt ..... A45D 40/265 401/126
2012/0048290 A1* 3/2012 Cappello ..... A45D 33/14 132/218
2012/0132222 A1* 5/2012 Gueret ..... A45D 34/046 132/200
2012/0325235 A1* 12/2012 Bouix ..... A45D 40/265 132/200
2014/0037360 A1* 2/2014 Hofmann ..... A45D 40/265 401/129
2015/0053233 A1* 2/2015 Lim ..... A45D 40/00 132/218
2015/0128980 A1* 5/2015 Park ..... A45D 34/045 132/73
2015/0157111 A1* 6/2015 Smith-Thompson ..... A45D 40/262 132/200
2016/0009467 A1* 1/2016 Baranes ..... A45D 34/045 401/129
2016/0374457 A1* 12/2016 Golding ..... A45D 40/265 132/317

FOREIGN PATENT DOCUMENTS

DE 20 2011 104 712 U1 11/2012
EP 2 342 991 A1 7/2011
FR 2 890 296 A1 3/2007
FR 2 933 281 A1 1/2010
FR 2 947 702 A1 1/2011
JP H09-070314 A 3/1997
JP 3098191 U 2/2004
JP 2006-021430 A 1/2006
JP 2009-261850 A 11/2009

OTHER PUBLICATIONS

Jan. 20, 2016 Written Opinion of the International Searching Authority issued in International Application No. PCT/EP2015/077275.
Jan. 20, 2016 International Search Report issued in International Application No. PCT/EP2015/077275.
Nov. 6, 2017 Office Action issued in Japanese Patent Application No. 2017-527243.

* cited by examiner

APPLICATOR FOR APPLYING A COSMETIC, MAKE-UP OR CARE PRODUCT

The present invention relates to applicators for applying a cosmetic, makeup or care product, especially eyeliner or nail varnish or lip gloss to the eyelids, the nails, the skin or the lips for example, and also to devices for the packaging and application especially of eyeliner.

A pen for writing or applying a cosmetic product, the handle of which is curved to conform to the shape of the hand, comprising a first guiding surface for supporting an inner surface of the hand and a second guiding surface for the passage thereon of a finger, is known from the utility model DE 20 2011 104 712 U1.

Making up the eyelids is a difficult operation to carry out and generally consists in drawing a line of eyeliner while holding the eyelid taut, moving the applicator member parallel to the eyelid and to the eyelash fringe, from one corner of the eyelid to the other. This operation is relatively difficult to accomplish with a brush, given the small size of the surface to be made up and the necessary precision, and kohl pencils are preferentially used by consumers.

Applicators that attempt to make this operation easier by trying to improve the way in which the user holds the applicator member have been proposed. In spite of the wide variety of applicators which it has been possible to propose, this makeup operation remains difficult.

Consequently, there is a need to facilitate this operation without otherwise impairing the quality of the makeup result achieved.

Therefore, according to a first of its aspects, a subject of the invention is an applicator for applying an eyeliner, which extends along a rectilinear longitudinal axis X and comprises:

an applicator member, in particular an applicator tip, a holder carrying the applicator member, which extends along a visible length $L_2$ of the holder measured along the longitudinal axis X of the applicator, a handle defining a gripping surface enabling the user to hold the applicator during the application of the product, the handle having at least one cross section, taken perpendicularly to the longitudinal axis X of the applicator, of substantially triangular overall shape, and the handle extending along a length $L_1$ measured along the longitudinal axis X of the applicator, an $L_1/L_2$ ratio of the length of the handle $L_1$ to the visible length of the holder $L_2$ being greater than 2, especially being between 2 and 7 and better still between 3 and 6.

The applicator according to the invention is fitted with a handle which is relatively long compared to the holder. This handle is sufficiently long to rest, via its distal portion, on the interdigital web between the thumb and the index finger, which may make it possible to ensure better holding in place thereof, and hence to improve application precision.

In addition, the holder is relatively short, which may facilitate the making up operation, since the fingers which rest on the handle are located closer to the applicator member, which enables more precise guiding of the applicator member.

The handle may have at least two spaced-apart cross sections of substantially triangular overall shape. The two cross sections of substantially triangular overall shape may be angularly offset relative to one another.

The holder may extend along a visible length $L_2$ greater than 7 mm, better still greater than 9 mm, especially being between 7 and 25 mm, better still between 8 and 20 mm.

"Visible length of the holder" is intended to mean the length of the portion of the holder which is visible when the applicator in its entirety is viewed from the side. The visible length of the holder may result from the difference between the total length of the applicator, from which the length of the handle and that of the applicator member are subtracted.

The length $L_1$ is preferably between 40 and 90 mm, better still between 50 and 80 mm.

The greatest width l of the handle may be between 8 and 30 mm, better still between 10 and 20 mm. The greatest width corresponds to the largest transverse dimension which can be measured over the whole length of the handle. It may be given for example by the diameter of a circle in which the cross section of the handle is inscribed. It may be situated at the proximal end of the handle, closest to the applicator member.

The $L_1/l$ ratio of the length $L_1$ of the handle to the greatest width l thereof is preferably between 2 and 7, better still between 3 and 6.

The substantially triangular shape of the cross section favors holding the handle between three fingers of one hand by a three-fingered grip, between the thumb, the index finger and the middle finger. Each finger may rest comfortably and stably on a facet of the substantially planar or slightly curved handle.

The handle may have at least two spaced-apart cross sections of substantially triangular overall shape and at least one median cross section of a shape other than substantially triangular.

Each substantially triangular section is preferably substantially an isosceles or equilateral triangle.

The applicator may have a first cross section, taken perpendicularly to the longitudinal axis X of the applicator, of substantially triangular overall shape, situated close to the distal end of the applicator, that is to say close to the holder and to the applicator member. The presence of this substantially triangular section close to the applicator member enables the applicator to be gripped between three fingers of the hand, one side resting on the middle finger and the two others being in contact, one with the thumb and the other with the index finger. Thus, the applicator is well held in place in the user's hand without risk of inopportune rotation.

In addition, the applicator may have a second cross section of substantially triangular overall shape, situated close to the proximal end of the handle. The presence at the proximal end of the handle of a substantially triangular section makes it possible to position the applicator in a satisfactory manner in the user's hand, since the end of the handle can rest on the interdigital web between the thumb and index finger. The handle may rest on this interdigital web either by way of a facet, which may prevent the handle from rotating in the hand, or by way of a ridge arranged between two facets of the handle, which may make it possible to hold the handle in place in the hand, by a certain effect of pushing of this ridge into the depression of the web. The choice between these positions may depend on the user, seeking the maximum comfort for application.

The two cross sections of substantially triangular overall shape may be angularly offset relative to one another. The angular offset may be between 40 and 80°, being for example of the order of 60°, such that the vertices of the triangles of the two sections of substantially triangular overall shape are offset uniformly and regularly. Thus, the handle of the applicator according to the invention may have a twisted appearance, taking into account this angular offset.

The handle may have at least three facets defining the cross section of substantially triangular overall shape, these facets being nonparallel to the longitudinal axis X of the applicator. These facets may be inwardly inclined with increasing distance from the distal end of the handle, which may favor the pressing of the fingers onto these facets, preventing them slipping in the direction of the holder. The facets may each be symmetrical relative to a median plane containing the longitudinal axis X of the applicator. When the handle is viewed from the side, substantially parallel to the side defined by a facet, this facet may appear curved and concave towards the outside.

The handle has at least six facets interlocking top-to-tail around the longitudinal axis X of the applicator. The bases of three of the facets may be situated at the distal end of the handle, and the bases of the three other facets may be situated at the proximal end of the handle.

The handle may comprise a narrowed intermediate portion. This portion may be situated approximately ⅓ $L_1$ from the distal end and ⅔ $L_1$ from the proximal end.

Another subject of the invention, independently or in combination with the above, is an applicator for applying an eyeliner, which extends along a rectilinear longitudinal axis X and comprises:

an applicator member, in particular an applicator tip, a holder carrying the applicator member, a handle defining a gripping surface enabling the user to hold the applicator during the application of the product, the handle having at least two spaced-apart cross sections, each of substantially triangular overall shape, and at least one intermediate cross section of a shape other than substantially triangular.

The two cross sections of substantially triangular overall shape are preferably angularly offset relative to one another, especially by 60°. The two sections may be of different sizes, the section at the proximal end of the handle being smaller than that at the distal end of the handle. In addition, the handle may comprise a narrowed intermediate portion. Moreover, the applicator may comprise one or the other of the features described above, alone or in combination.

The applicator member may be a flocked end piece made of elastomer, a brush, a felt, a foam end piece, or an injection-molded pen which is or is not flocked. It is preferably flexible, comprising for example a body made of a thermoplastic elastomer. In the case of a felt, it preferably comprises longitudinally oriented fibers that are bonded together. The product may diffuse by capillary action within the applicator member on account of its porosity. The fibers may be fibers made of thermoplastic material, especially made of acrylic polymer, polyester or polyamide. The fibers may have a linear density of less than 1 denier, preferably between 0.5 and 0.9 denier, especially 0.7 denier (i. e. around 9 micrometres). The fibers may be made of Nylon®.

Along at least a part of its length, the applicator member may have a cross section that is not rotationally symmetric. This makes it possible to draw a more or less fine line depending on the orientation of the applicator member with respect to the direction of movement relative to the eyelid.

The dimensions of the applicator member are such that the maximum thickness of the line of product drawn on the skin is preferably less than or equal to 5 mm, better still less than or equal to 3 mm, when the applicator member is moved perpendicularly to the skin. Depending on the orientation of the applicator member relative to the eyelid, it is possible for example to vary the thickness of the line.

The applicator member may be fixed to the holder by any means, for example force-fitted into a corresponding housing provided at the end of the holder.

Preferably, the applicator member is an applicator tip, which is or is not provided, at its end, with a spatula or a widened head as described in application FR 2 933 281.

The applicator tip may comprise an end piece for fixing to the applicator holder which has a diameter greater than the width of the fine line which is drawn by the applicator when the latter is moved in a manner oriented perpendicularly to the skin.

The handle may be produced in the form of a cap for closing a container. The holder or the handle may be designed to close the container, especially in a leaktight manner, when it is not being used.

The handle may be produced in a single material, for example by molding, or with an overmolding of a second, more flexible material, making it possible to facilitate the gripping of the handle.

The eyeliner may comprise an aqueous or organic solvent and a pigment, especially an iron oxide. The eyeliner contains for example water, a pigment, in particular iron oxide and/or a dye, and polymers.

A further subject of the invention is a packaging and application device comprising a container containing the eyeliner to be applied, and an applicator according to the invention, as defined above.

Where appropriate, the container may comprise a ball for homogenizing its contents by shaking the container.

The capacity of the container is for example between 1 and 6 ml.

The applicator member is supplied with product by being dipped in the container or alternatively the application surface is supplied with product by capillary action through the applicator member, in a similar way to marker pens.

In such a variant embodiment, the product, especially the eyeliner, may be contained in a reservoir disposed inside the handle, the applicator then forming an eyeliner applicator pen. In this case, the applicator member is preferably porous on the inside, with an elongate shape, being supplied with eyeliner by the reservoir. The applicator may comprise a stopper which is fixed, for example by snap-fastening, screwing or friction, into the handle of the applicator and which serves for mounting on the neck of the container.

In this example, the applicator member is supplied with product through its proximal end and the product can diffuse longitudinally in the applicator member until it reaches the portion intended to come into contact with the skin. In this case, the applicator member has a base which serves to fix it to the holder, and a tip which serves for application by coming into contact with the skin in order to deposit thereon eyeliner which impregnates the felt of the applicator member.

A further subject of the invention is a method for making up the eyelid, wherein use is made of an applicator or a device according to the invention to draw a line on the eyelid. The orientation of the applicator member, especially of the applicator tip, may be altered relative to the eyelid and to the gripping surface during the makeup operation.

The user may position the handle with a desired orientation relative to the eyelid, as a function of the thickness of the line to be drawn on the eyelid.

Figure 2:
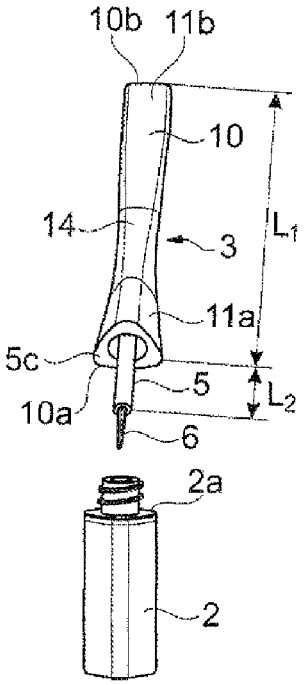
Figure 3A:
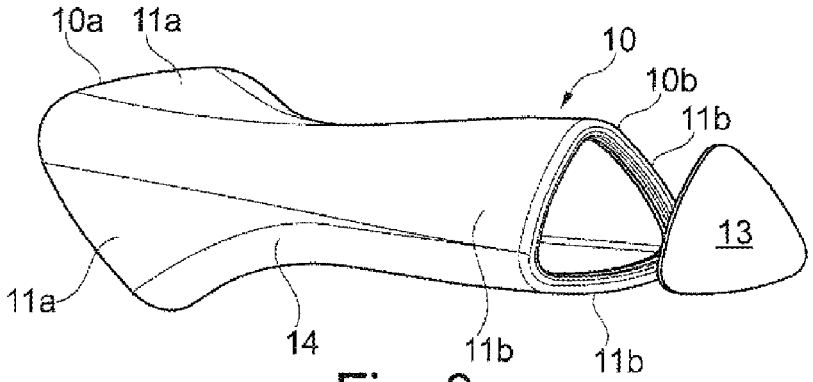
Figure 3B:
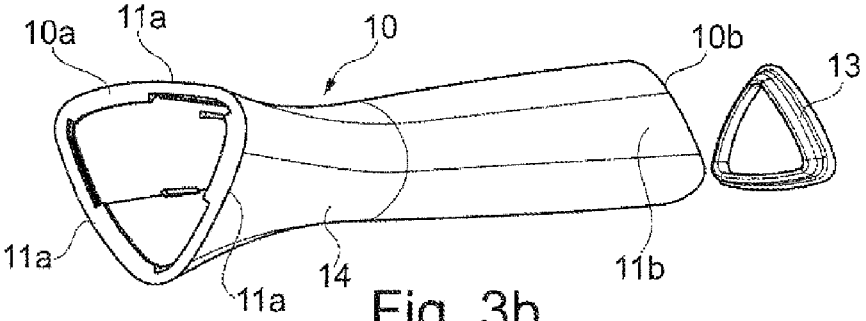
Figure 4A:
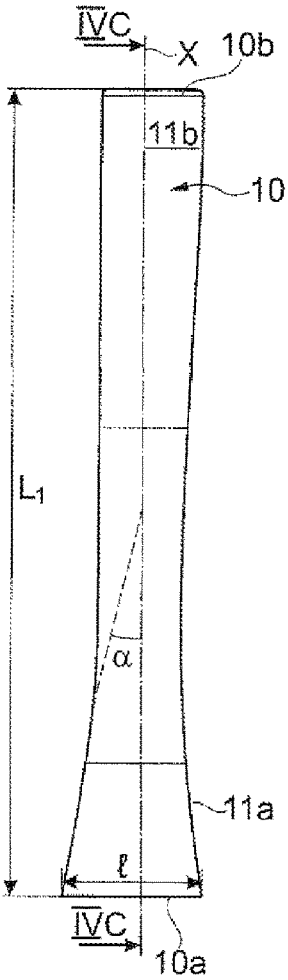
Figure 4B:
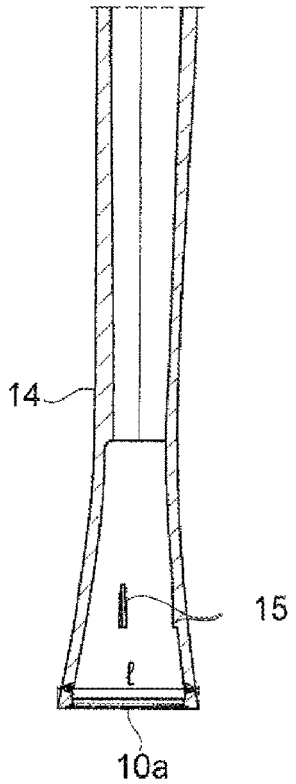
Figure 4C:
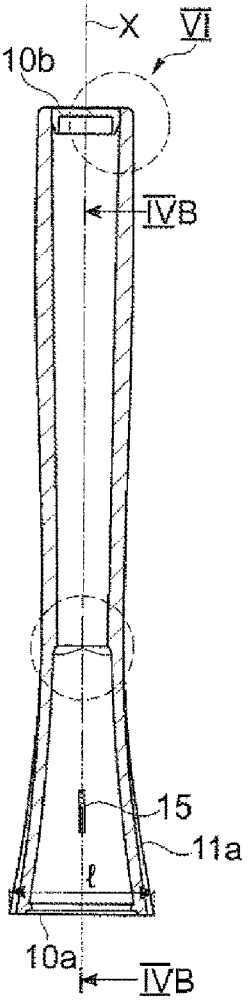
Figure 5B:
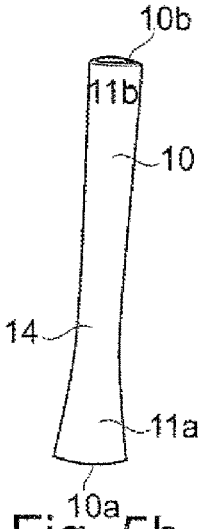
Figure 6:
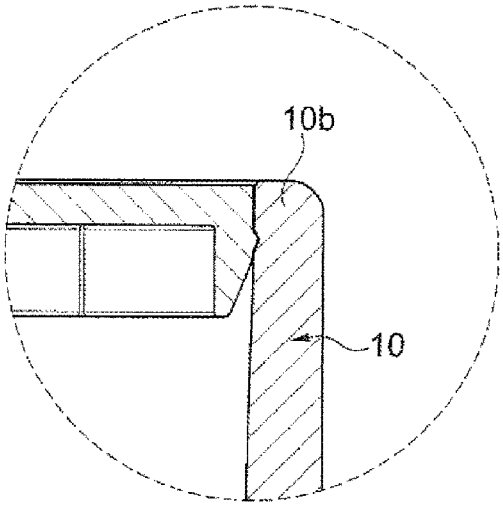
Figure 5A:
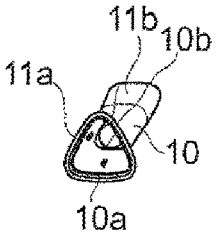
Figure 5C:
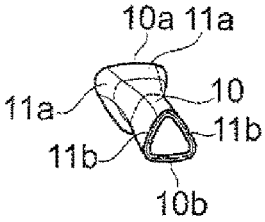
Figure 7:
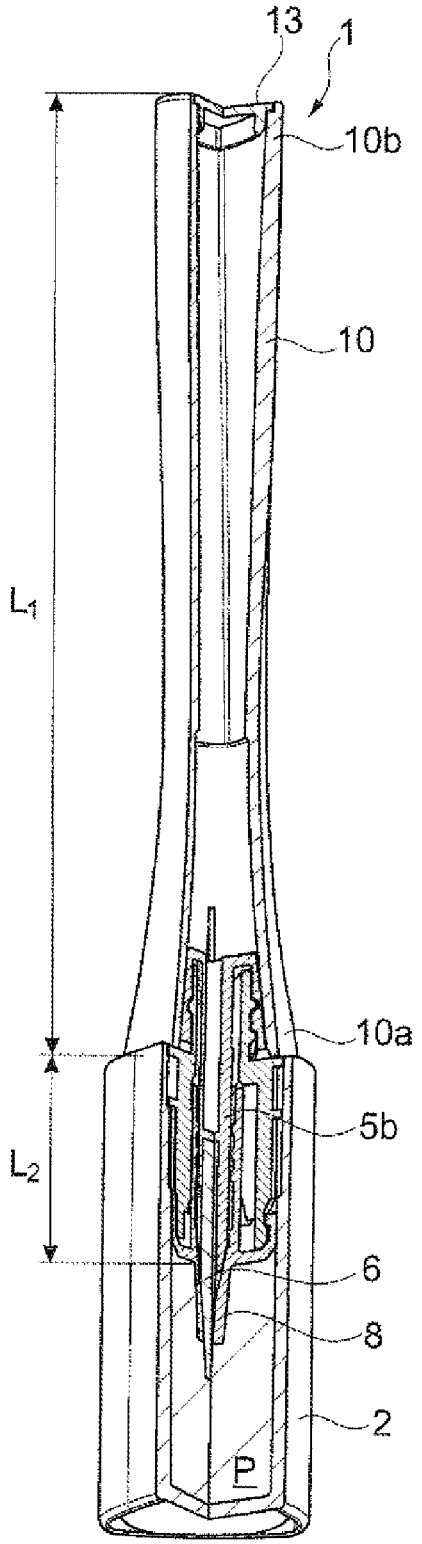
Figure 8:
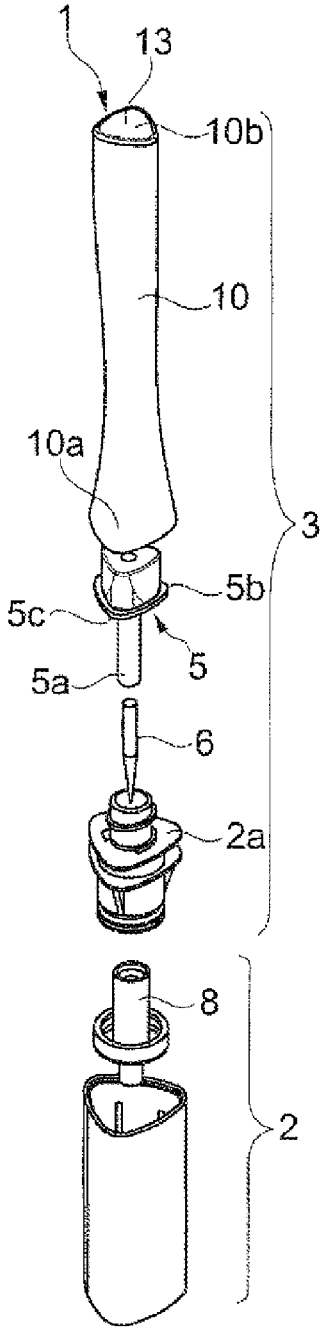
Figure 9A:
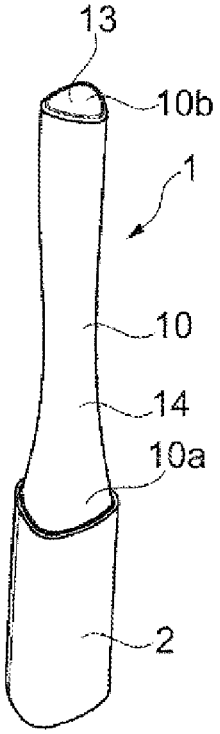
Figure 9B:
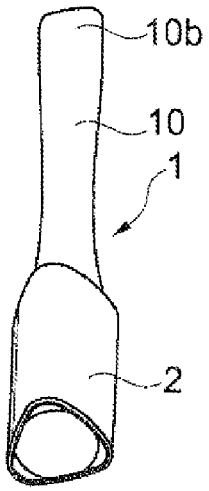
Figure 10A:
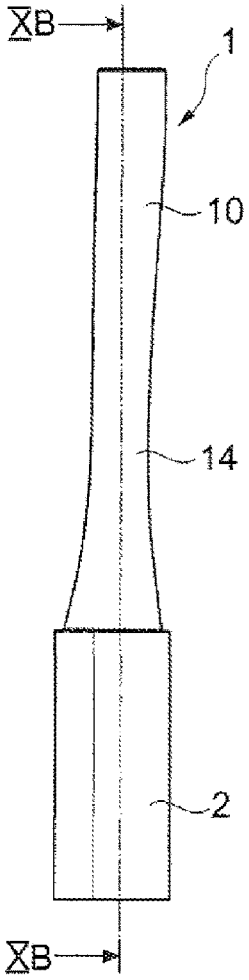
Figure 10B:
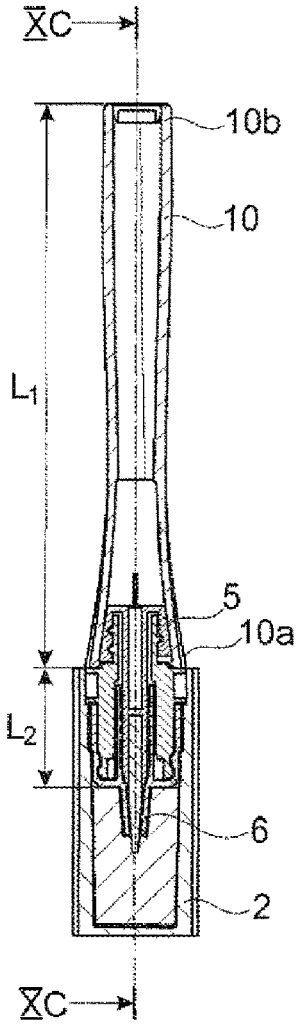
Figure 10C:
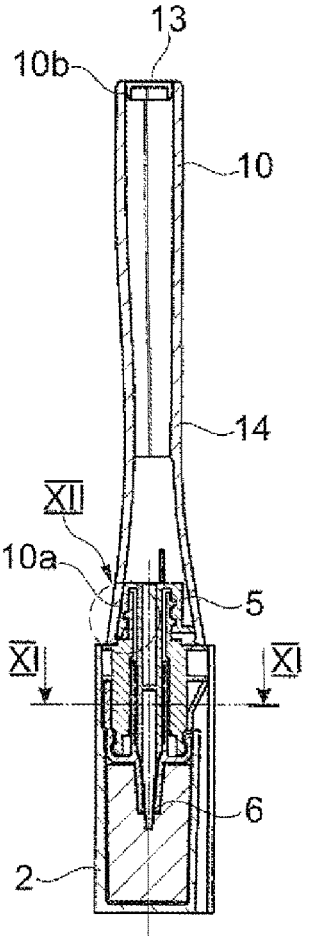
Figure 11:
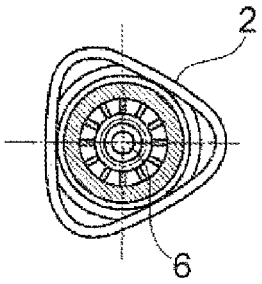
Figure 12:
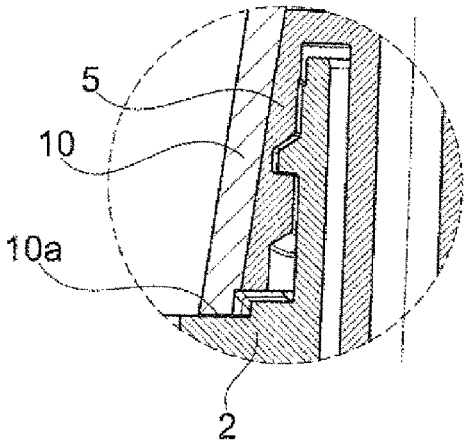
Figure 13A:
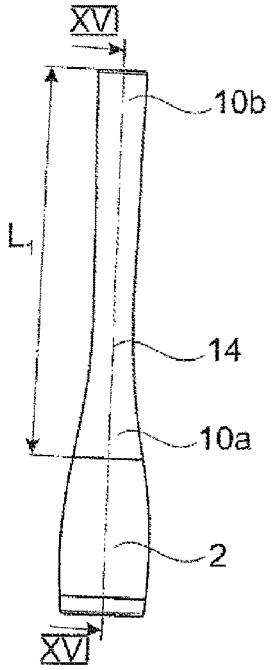
Figure 13B:
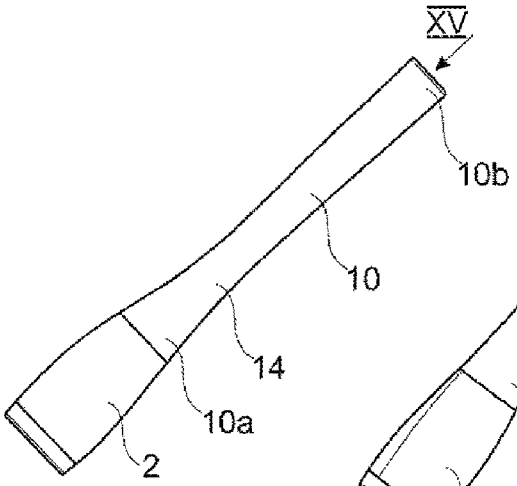
Figure 13C:
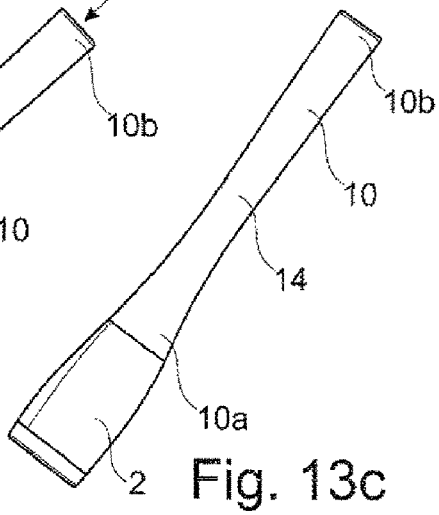
Figure 14:
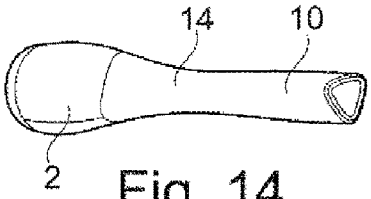
Figure 15:
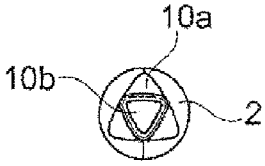
Figure 16:
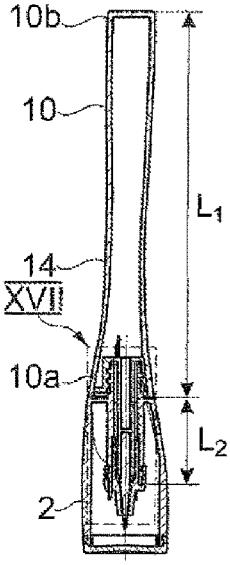
Figure 17:
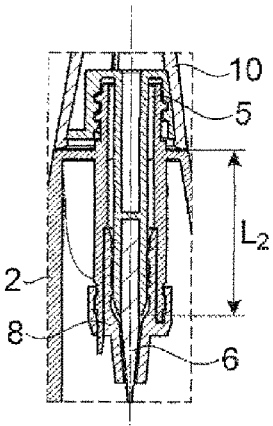
Figure 18:
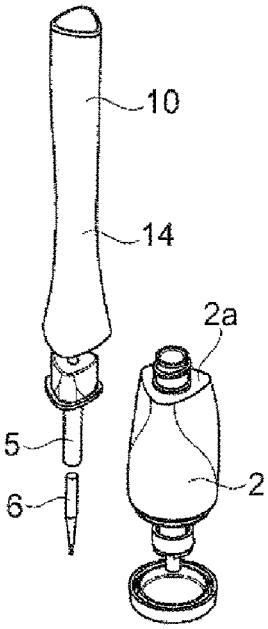
Figure 19:
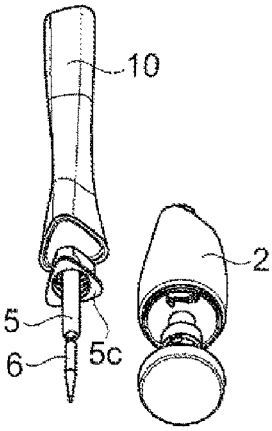

The invention may be better understood from reading the following detailed description of nonlimiting exemplary embodiments thereof and from examining the appended drawing, in which:

FIGS. 1 and 2 are perspective views, in the closed position and open position, respectively, of an example of a packaging and application device in accordance with the invention, FIGS. 3*a* and 3*b* are perspective views of the handle of the device in FIGS. 1 and 2, FIG. 4*a* is a side view of this same handle, FIGS. 4*b* and 4*c* are views in longitudinal section of said handle, along IV B and IV C, respectively, FIGS. 5*a* to 5*c* are other perspective views of the handle of the device in FIGS. 1 and 2, FIG. 6 is a view of detail VI of FIG. 4*c*, FIG. 7 is a view in partial longitudinal section of a variant embodiment, FIG. 8 is an exploded perspective view thereof, FIGS. 9*a* and 9*b* are perspective views thereof, FIG. 10*a* is a side view of this same device, FIGS. 10*b* and 10*c* are views in longitudinal section, along X B and X C, respectively, FIG. 11 is a cross section thereof along XI-XI, FIG. 12 is a view of detail XII of FIG. 10, FIGS. 13*a* to 13*c* are side views of a variant embodiment, FIG. 14 is a perspective view thereof, FIG. 15 is a top view thereof along XV in FIG. 13*b*, FIG. 16 is a longitudinal section thereof along XVI-XVI in FIG. 13*a*, FIG. 17 is a view of detail XVII in FIG. 16, and FIGS. 18 and 19 are exploded perspective views of the applicator in FIGS. 13*a* to 17.

The packaging and application device 1 shown in FIGS. 1 to 6 comprises a container 2 containing the eyeliner to be applied and an applicator 3 which, when not being used to apply the product, can be mounted on the container 2 in order to close it, as illustrated in FIG. 1, and can be separated from the container in order to apply the product, as illustrated in FIG. 2. The applicator 3 extends along a rectilinear longitudinal axis X.

The container 2 comprises for example a threaded neck onto which the applicator 3 can be screwed, the latter comprising a holder 5 carrying an applicator member 6 constituted by an applicator tip.

The applicator member 6 can be produced in various ways, with a shape which allows the user to draw a more or less thick line depending on the orientation of the applicator member 6 with respect to the eyelid and the direction of movement thereon.

The applicator member 6 can be formed by a felt tip or by an end piece made of an elastomer material, which may or may not be flocked at its distal end. Examples of applicator members that may be suitable are described especially in the publications FR 2 933 281, FR 2 947 702, FR 2 890 296 and U.S. Pat. No. 7 077 592.

The applicator 3 comprises a handle 10 defining a gripping surface that allows the user to hold the applicator while applying the product.

The handle 10 comprises at least two spaced-apart cross sections of substantially triangular overall shape.

The applicator thus comprises a first cross section, taken perpendicularly to the longitudinal axis X of the applicator, with a substantially triangular overall shape, situated closer to the distal end 10*a* of the handle, that is to say closer to the holder 5 and to the applicator member 6. The handle thus has three facets 11*a* arranged so as to define the first cross section of substantially triangular overall shape. The facets 11*a* are nonparallel to the longitudinal axis X of the applicator, being inclined by an angle a which may vary relative to the axis X, as illustrated in FIG. 4*a*. The inclination thereof favors the pressing of the fingers onto the facets and prevents them slipping in the direction of the holder 5. The angle of inclination $\alpha$ may be of the order of 12° at the distal end of the handle 10.

The container 2 comprises a shoulder 2*a*, also of substantially triangular shape.

In addition, the applicator comprises a second cross section, taken perpendicularly to the longitudinal axis X, of substantially triangular overall shape, which is situated closer to the proximal end of the applicator.

The handle thus has three facets 11*b* arranged so as to define the cross section of substantially triangular overall shape.

The facets 11*a* and 11*b* are each symmetrical relative to a median plane containing the longitudinal axis X of the applicator.

The six facets 11*a* and 11*b* of the handle 10 are arranged interlocking around the longitudinal axis X of the applicator. The bases of the three facets 11*b* are situated at the proximal end 10*b* of the handle, and the bases of the three other facets 11*a* are situated at the distal end 10*a* of the handle.

The handle 10 also comprises a narrowed intermediate portion 14, situated in the example described approximately ⅓ $L_1$ from the proximal end and approximately ⅔ $L_1$ from the distal end, $L_1$ denoting the length of the handle. The handle thus has at least one intermediate cross section of a shape other than substantially triangular, which is situated along the longitudinal axis X of the applicator, between the two cross sections of substantially triangular overall shape.

The two cross sections of substantially triangular overall shape are angularly offset relative to one another. The angular offset is 60°, such that the vertices of the triangles of the two sections of substantially triangular overall shape are offset uniformly and regularly, as can be seen in the figures. Thus, the handle of the applicator according to the invention has a twisted appearance.

The handle 10 houses a stopper 13 at the proximal end 10*b* thereof, more particularly visible in FIGS. 3*a*, 3*b* and 6. It is fixed to the handle 10 by snap-fastening, by cooperation of an annular bead with a corresponding annular groove in the handle.

$L_2$ being the visible length of the holder measured along the longitudinal axis X of the applicator, the $L_1/L_2$ ratio is greater than 2, better still greater than 3. This ratio may especially be between 2 and 7, and even between 3 and 6.

In the example described, the visible length $L_2$ is of the order of 20 mm. In the example described, the length $L_1$ is of the order of 85 mm.

The greatest width of the handle 1 is around 15 mm in the example described. This greatest width is situated in this case at the distal end 10*a* of the handle, closest to the applicator member 6.

The $L_1/l$ ratio of the length $L_1$ of the handle to the greatest width 1 thereof is of the order of 5 in the example described.

The handle comprises snap-fastening ridges 15 on its inner surface, which are intended for fixing the holder 5 in the handle 10. In the exemplary embodiment described, the handle comprises three ridges 15 each arranged at 120° from one another, and close to its distal end 10*a*, as illustrated.

The structures of the holder, of the applicator member and of the container will be described in more detail in conjunction with the embodiment of FIGS. 7 to 12, but may of course be identical for the embodiment of FIGS. 1 to 6.

The holder 5 comprises a stem 5*a* which supports the applicator member 6 at its distal end and an end piece 5*b* for fixing to the handle 10 at its proximal end, as can be seen in FIGS. 7 and 8. This fixation end piece 5*b* is terminated by a triangular flange 5*c*.

The container 2 houses an open-ended perforated sheath 8, beyond which the applicator member 6 may extend a short distance to be loaded with the product P contained in the container. An example of such an arrangement is disclosed especially in the publication FR 2 947 702.

It is possible for the container to have various shapes, for example an elongated shape with a generally constant outer cross section, which is triangular in the embodiment of FIGS. 1 to 6, and in that of FIGS. 7 to 12.

In the embodiment of FIGS. 13*a* to 19, the container has a non-constant shape when moving along the longitudinal axis X of the device. The cross section of the container is substantially triangular in shape at its point of attachment to the handle, and circular in shape towards the bottom of the container.

In the exemplary embodiments which have just been described, the container 2 is separated from the applicator 3 during application of the product.

As a variant, the container 2 remains attached to the applicator member during application of the product, the applicator member 6 being for example supplied with product through an internal channel from the container 2, the latter possibly being provided with a pump, or else with a free reservoir or a reservoir comprising an impregnated pad enabling supply by capillary action, or with any other system making it possible to force the product to flow through the abovementioned internal channel to reach the application surface.

The application surface may also be supplied by virtue of the porosity of the applicator member, by capillary action, through the applicator member.

Needless to say, the invention is not limited to the examples that have just been described.

In particular, the features of the various examples illustrated can be combined within variants that are not illustrated.

The applicator tip may be a flocked or non-flocked felt, a sintered product, a brush or a flocked end-piece. The applicator tip preferably has a single, rounded apex. In a variant, the applicator tip is a "double liner", with two apices, making it possible to draw two lines simultaneously.

The expression "comprising a" should be understood as being synonymous with "comprising at least one", unless specified to the contrary.

The invention claimed is:

1. A packaging and application device comprising:

a container containing an eyeliner to be applied; and an applicator for applying the eyeliner, which extends along a rectilinear longitudinal axis and comprises:

a handle defining a gripping surface enabling a user to hold the applicator during application of the eyeliner, the handle extending along a length measured along the longitudinal axis of the applicator, a holder extending from a distal end of the handle, the holder having a visible length that extends along the longitudinal axis of the applicator, and an applicator member supported on a distal end of the holder, wherein:

the visible length of the holder is the length of the holder that extends from the distal end of the handle to a proximal end of the applicator member, a ratio of the length of the handle to the visible length of the holder is greater than 2, and the handle has, taken perpendicularly to the longitudinal axis of the applicator, (i) at least two spaced-apart cross sections of substantially triangular overall shape, the two cross sections of substantially triangular overall shape being angularly offset relative to one another on a same monolithic portion of the handle, and (ii) at least one intermediate cross section of a shape other than substantially triangular.

2. The device as claimed in claim 1, wherein the visible length of the holder is greater than 7 mm.

3. The device as claimed in claim 1, wherein the length of the handle is between 40 and 90 mm.

4. The device as claimed in claim 1, wherein a greatest width of the handle is between 8 and 30 mm.

5. The device as claimed in claim 1, wherein a ratio of the length of the handle to a greatest width thereof is between 2 and 7.

6. The device as claimed in claim 1, wherein the handle has at least three facets arranged so as to define a first one of the at least two spaced-apart cross sections of substantially triangular overall shape, said facets being nonparallel to the longitudinal axis of the applicator.

7. The device as claimed in claim 1, wherein the handle has at least six facets interlocking top-to-tail around the longitudinal axis of the applicator.

8. The device as claimed in claim 1, wherein the handle has a narrowed intermediate portion.

9. A method for making up an eyelid, comprising drawing a line on the eyelid using the device as claimed in claim 1.

* * * * *